US008239990B2

(12) United States Patent
Lim et al.

(10) Patent No.: US 8,239,990 B2
(45) Date of Patent: Aug. 14, 2012

(54) APPARATUS AND METHOD FOR MACHINE WASHING

(75) Inventors: Jung Soo Lim, Hwaseong-si (KR); Phil Soo Chang, Seongnam-si (KR); Hye Soon Yang, Yongin-si (KR); Young Hoon Kang, Suwon-si (KR); Byoung Yull Yang, Hwaseong-si (KR); Tal Eun Kim, Suwon-si (KR); Hee Won Jin, Seoul (KR); Hye Ryung Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 837 days.

(21) Appl. No.: 12/078,480

(22) Filed: Mar. 31, 2008

(65) Prior Publication Data

US 2008/0244835 A1 Oct. 9, 2008

(30) Foreign Application Priority Data

Apr. 6, 2007 (KR) ..... 10-2007-0034424

(51) Int. Cl.
*D06F 39/02* (2006.01)
*D06F 35/00* (2006.01)

(52) U.S. Cl. ..... 8/158; 68/17 R

(58) Field of Classification Search ..... 68/17 R, 68/3 R, 12.01, 12.18, 12.19, 13 R; 8/158, 8/159

See application file for complete search history.

(56) References Cited

U.S. PATENT DOCUMENTS 3,194,628 A * 7/1965 Cannon ..... 8/137
4,481,086 A * 11/1984 Bianchi et al. ..... 204/229.6
4,755,268 A * 7/1988 Matsuo et al. ..... 205/746
6,253,584 B1 * 7/2001 Shin ..... 68/13 R
6,743,351 B1 * 6/2004 Arai et al. ..... 205/701
7,296,444 B2 * 11/2007 Mae et al. ..... 68/12.04
7,322,065 B2 * 1/2008 Kim et al. ..... 8/158
7,407,924 B2 8/2008 Arai et al.
7,493,784 B2 * 2/2009 Nomura ..... 68/13 A
7,617,704 B2 * 11/2009 Iimori et al. ..... 68/17 R
7,624,601 B2 * 12/2009 Ikemizu et al. ..... 68/17 R
7,905,121 B2 * 3/2011 Ikemizu et al. ..... 68/12.06
2003/0213503 A1 * 11/2003 Price et al. ..... 134/18
2003/0213505 A1 * 11/2003 Price et al. ..... 134/25.2
2004/0025263 A1 * 2/2004 Kim et al. ..... 8/159

(Continued)

FOREIGN PATENT DOCUMENTS

CN 1572967 2/2005

(Continued)

OTHER PUBLICATIONS

Japanese Office Action issued Nov. 24, 2010 in corresponding Japanese Patent Application 2008-087808.

(Continued)

*Primary Examiner* — Joseph L Perrin
(74) *Attorney, Agent, or Firm* — Staas & Halsey LLP

(57) ABSTRACT

Disclosed is an apparatus and method for machine washing that includes a sterilizer capable of continuously exhibiting antibiotic and sterilization functions during washing and rinsing processes and reducing the consumption amount of Ag. The washing machine comprises a water reservoir to contain washing water, a sterilizer sterilizing the washing water through an electrolysis process, and a circulator circulating the washing water in the sterilizer.

12 Claims, 3 Drawing Sheets

U.S. PATENT DOCUMENTS

| | | | | |
|---|---|---|---|---|
| 2004/0168933 | A1 | 9/2004 | Inoue | |
| 2004/0172985 | A1* | 9/2004 | Mamiya et al. | 68/12.05 |
| 2004/0205899 | A1* | 10/2004 | Park et al. | 8/159 |
| 2005/0252255 | A1 | 11/2005 | Gray et al. | |
| 2006/0130533 | A1* | 6/2006 | Ooe et al. | 68/3 R |
| 2008/0041117 | A1* | 2/2008 | Lee | 68/17 R |

FOREIGN PATENT DOCUMENTS

| | | |
|---|---|---|
| CN | 1576239 | 2/2005 |
| GB | 1312681 | 4/1973 |
| JP | 2005-336834 | 12/2005 |
| JP | 2006-247367 | 9/2006 |
| JP | 2007-061175 | 3/2007 |
| KR | 10-2000-0060149 | 10/2000 |
| KR | 10-2003-0060302 | 7/2003 |
| KR | 10-2004-0000866 | 1/2004 |
| WO | 0246348 | 6/2002 |
| WO | 03/096866 | 11/2003 |
| WO | 2005/056908 | 6/2005 |
| WO | 2006/044951 | 4/2006 |
| WO | WO 2006/117201 A1 | 11/2006 |

OTHER PUBLICATIONS

Russian Search report dated Feb. 2, 2009 issued in Russian Patent Application No. 2008112041/12.

Electrochemistry, vol. 6, No. 1, Feb. 2000, pp. 72-77.

Office Action, mailed Feb. 5, 2010, in corresponding Chinese Application No. 200810085884X (9 pp.).

European Search Report dated Aug. 19, 2008, issued in corresponding European Patent Application.

Korean Office Action for corresponding Korean Patent Application No. 10-2007-0034424 dated Dec. 15, 2011.

* cited by examiner

APPARATUS AND METHOD FOR MACHINE WASHING

CROSS-REFERENCE TO RELATED APPLICATIONS

This application claims the benefit of Korean Patent Application No. 2007-0034424, filed on Apr. 6, 2007, in the Korean Intellectual Property Office, the disclosure of which is incorporated herein by reference.

BACKGROUND

1. Field

The present invention relates to a washing machine and a method of washing. More particularly, the present invention relates to a washing machine comprising a sterilizer that sterilizes washing water and a circulator that circulates the washing water in the sterilizer.

2. Description of the Related Art

In general, a washing machine washes the laundry in a washing tub by stirring the laundry together with washing water mixed with detergent.

Such a washing machine comprises a body forming an external appearance, a water reservoir installed in the body and containing washing water, a detergent supply apparatus that mixes detergent with water supplied from an exterior and supplies the water to the water reservoir.

Recently, an Ag solution supply apparatus, which supplies Ag solution by dissolving Ag ions exhibiting antibiotic and sterilization functions in washing water, has been added to the washing machine in order to wash the laundry and sterilize bacteria existing in the washing water and the laundry.

The Ag solution supply apparatus comprises one pair of Ag electrodes to which voltage is applied, and supplies Ag ions, which are generated by an Ag plate during electrolysis when the washing water passes through the Ag electrodes, to a water reservoir.

The Ag solution supply apparatus provided in the washing machine is installed on a water supply path, which supplies the washing water to the water reservoir, together with a detergent dissolver, and supplies the Ag ions to the washing water supplied to the water reservoir. However, the Ag solution supply apparatus cannot supply the Ag ions any more after the water supply is terminated, so antibiotic and sterilization functions cannot be continuously exhibited during washing and rinsing processes.

Further, the density of the Ag ions, which are generated by the Ag solution supply apparatus and provided to the washing water, is gradually reduced through reaction with other ions existing in the washing water, so the sterilization effect may be reduced. If many Ag ions are supplied to the washing water in consideration of the fact, consumption amount of Ag in the Ag plate may be increased, resulting in reduction of the life span of the Ag plate.

SUMMARY

Accordingly, one or more embodiments of the present invention provide a washing machine capable of continuously exhibiting antibiotic and sterilization functions during washing and rinsing processes.

One or more embodiments of the present invention also provide a washing machine capable of reducing consumption amount of Ag in an Ag plate.

Additional aspects and/or advantages of the invention will be set forth in part in the description which follows and, in part, will be apparent from the description, or may be learned by practice of the invention.

The foregoing and/or other aspects of embodiments of the present invention are achieved by providing a washing machine including a water reservoir to contain washing water, a sterilizer sterilizing the washing water through an electrolysis process, and a circulator circulating the washing water in the sterilizer.

The sterilizer comprises a first electrode including Ag and a second electrode including a metal having an ionization tendency lower than the ionization tendency of Ag.

The second electrode may comprise Ti.

The second electrode may also comprise Pt or Ir coated on a surface thereof.

The washing machine further comprises a power supply that supplies electric current to the first and second electrodes, and a controller that switches polarity of the electric current applied to the first and second electrodes.

The controller operates in a first mode, in which the first electrode becomes an anode and the second electrode becomes a cathode, or a second mode in which the second electrode becomes an anode and the first electrode becomes a cathode.

The circulator comprises a circulation pipe, which forms a circulation path such that the washing water is circulated in the water reservoir, and a circulation pump that pumps the washing water in the circulation path.

The circulation pipe may be provided along a circumference of the water reservoir.

The water reservoir comprises an inlet to introduce the washing water to the circulation path, and an outlet to discharge the washing water having passed the circulation path to the water reservoir.

The outlet may be provided at an upper portion of the water reservoir.

The outlet may be provided with an injection nozzle that injects the washing water such that the washing water is uniformly spread in the water reservoir.

The washing machine may further comprise a salt supply unit that supplies salt to the washing water.

The salt supply unit may be provided in a detergent supply apparatus that supplies detergent to the water reservoir.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
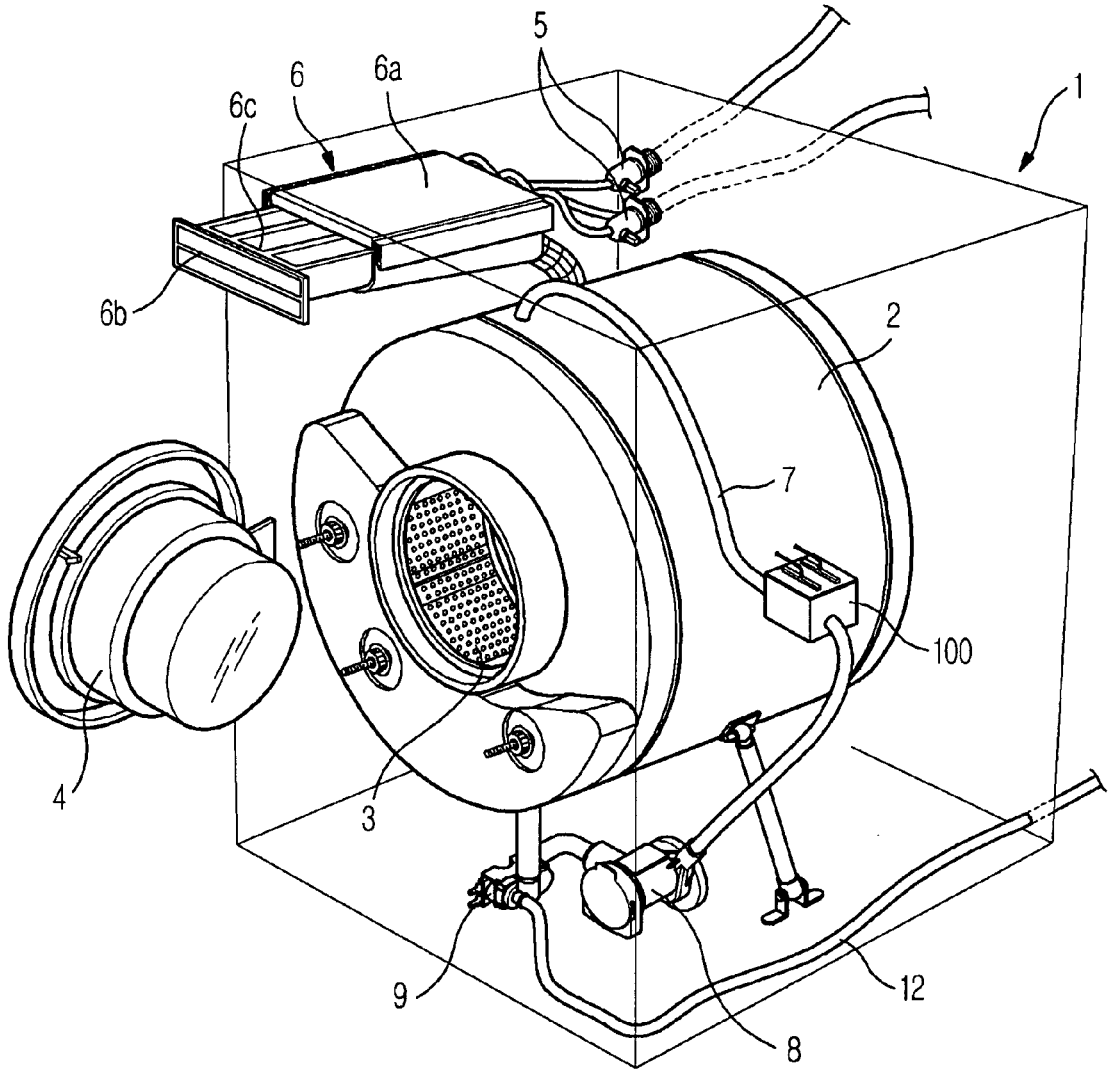
FIG. 1 is a schematic view illustrating an internal structure of a washing machine including a sterilizer used in embodiments of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a schematic view showing an internal structure of a washing machine according to an embodiment of the present invention.

The washing machine comprises a body 1 forming an external appearance, a water reservoir 2 installed in the body 1, and a drum 3 rotatably installed in the water reservoir 2.

A door 4 is installed in the front of the body 1 to open and close the opened front of the body 1. Water supply valves 5, which are connected to an external water supply source, and a detergent supply apparatus 6 are installed at the upper portion of the water reservoir 2, in which the detergent supply apparatus 6 dissolves detergent in water supplied through the water supply valves 5 and supplies the water to the water reservoir 2.

The detergent supply apparatus 6 comprises a housing 6*a* and a detergent box 6*b* detachably provided in the housing 6*a*.

A circulation pipe 7 that forms a circulation path is installed at the outer side of the water reservoir 2 such that the washing water can be circulated in the water reservoir 2. A circulation pump 8 is installed on the circulation path formed by the circulation pipe 7.

A three-way valve 9 is installed at the lower portion of the water reservoir 2 in order to switch a path between a drain pipe 12, which drains the washing water from the water reservoir 2, and the circulation pipe 7.

The circulation pipe 7 interconnects the upper and lower portions of the water reservoir 2 such that the washing water in the lower portion of the water reservoir 2 can be moved to the upper portion of the water reservoir 2. At this time, the circulation pump 8 pumps the washing water, which is supplied to the circulation pump 8 from the lower portion of the water reservoir 2 along the circulation pipe 7, such that the washing water can be discharged from the upper portion of the water reservoir 2.

A sterilizer 100 is installed above the circulation pump 8 to exhibit sterilization function by generating Ag ions through an electrolysis operation or activating the generated Ag ions.

Figure 2:
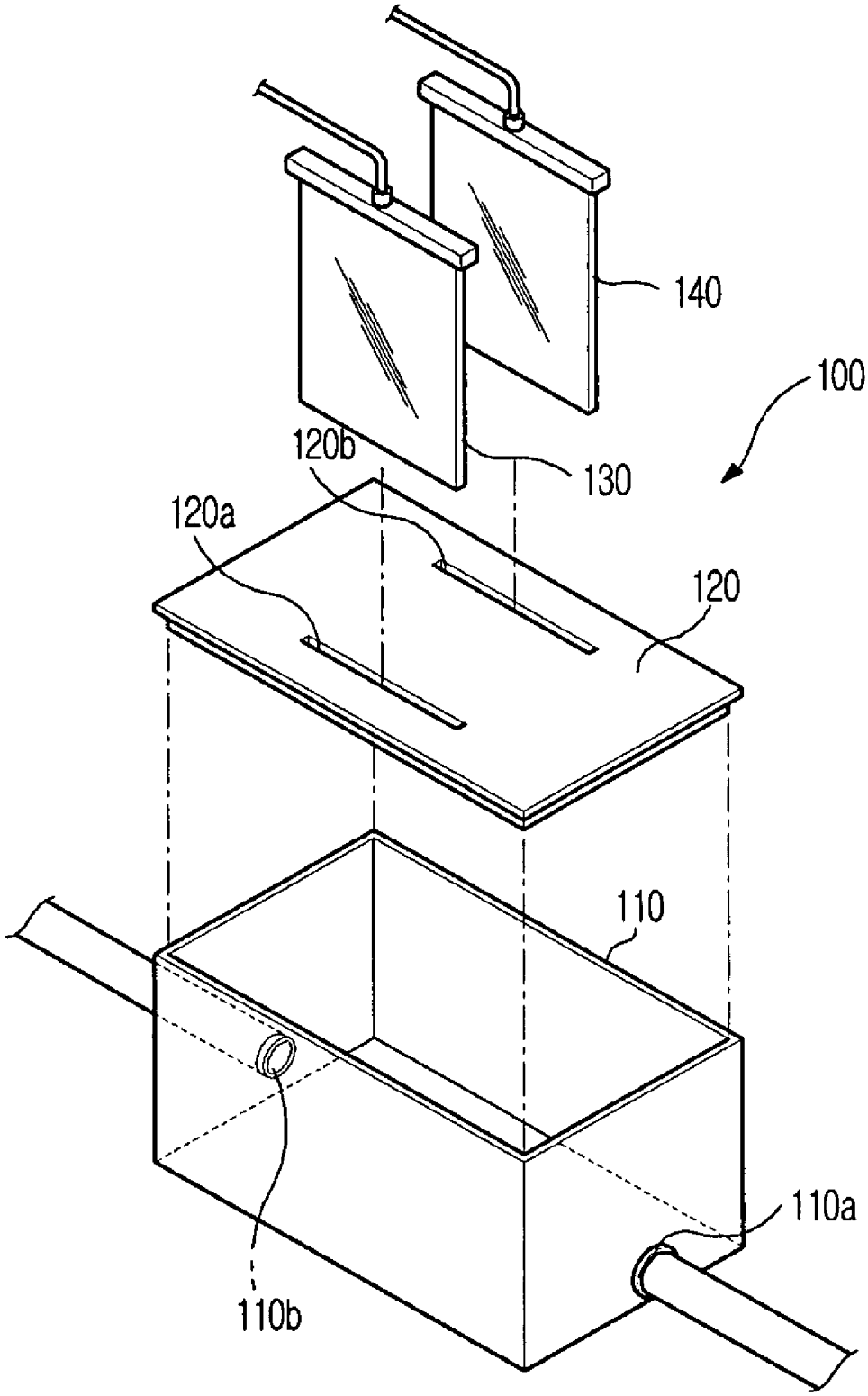
FIG. 2 is an exploded perspective view showing the construction of the sterilizer in FIG. 1.

FIG. 2 is an exploded perspective view showing the construction of the sterilizer in FIG. 1.

The sterilizer 100 comprises a storage container 110 having an inlet 110*a*, which has an opened upper surface and introduces washing water inside the sterilizer 100, and an outlet 110*b* that discharges the washing water.

A circulation pipe is connected between the inlet 110*a* and the outlet 110*b*, a cover 120 is installed at the opened upper surface of the storage container 110, and first and second electrodes 130 and 140 are installed at the cover 120 in order to form electrodes for electrolysis.

The first and second electrodes 130 and 140 are installed in the path in the storage container 110 through slots 120*a* and 120*b* formed in the cover 120, and are immersed when the washing water passes through the storage container 110.

Further, the first and second electrodes 130 and 140 have a plate shape as shown in FIG. 2, face each other, and are arranged in parallel with the flowing direction of the washing water in the storage container 110.

As the first and second electrodes 130 and 140 have a plate shape, the contact area with the washing water can be increased. However, in other embodiments, the electrodes may also have a bar shape.

The first and second electrodes 130 and 140 may comprise Ag and Ti, respectively. In addition to Ti, the second electrode 140 may also comprise other metals featuring an ionization tendency lower than that of Ag.

When the second electrode 140 comprises Ti, metals (e.g. Pt and Ir) having an ionization tendency lower than that of Ag may be coated on the surface of the second electrode 140 through plating in order to improve the corrosion-resistance.

Figure 3:
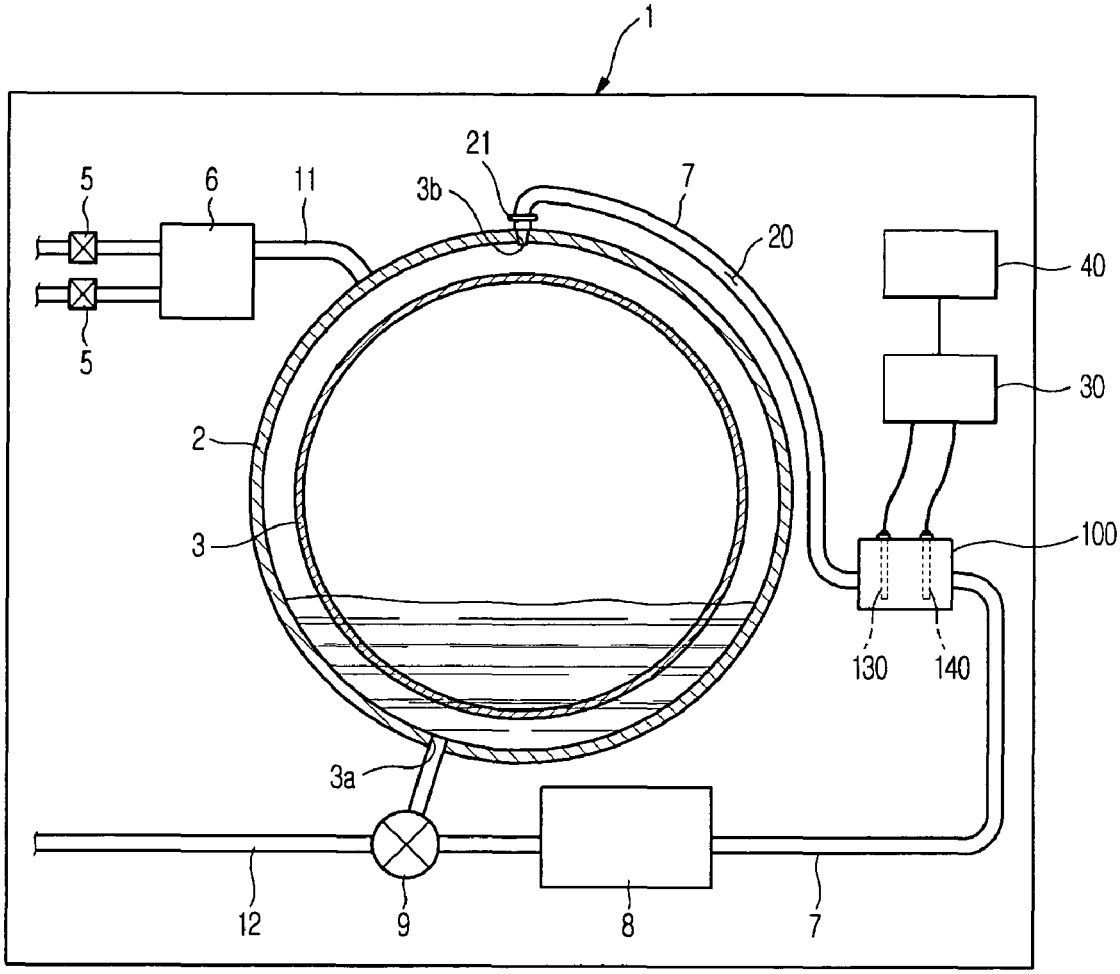
FIG. 3 is a schematic view showing an internal structure of the washing machine in FIG. 1.

FIG. 3 is a schematic view showing an internal structure of the washing machine in FIG. 1.

The water reservoir 2 is installed in the body 1 of the washing machine, and the drum 3 is installed in the water reservoir 2.

The water supply valves 5 that supply water to the water reservoir 2 are connected to the detergent supply apparatus 6 through a water supply pipe 11 at the upper portion of the water reservoir 2, and an outlet 3*b* and an inlet 3*a* are formed at the upper and lower portions of the water reservoir 2, respectively.

The circulation pipe 7 that forms a circulation path 20 by interconnecting the outlet 3*b* and the inlet 3*a* is connected to the outer side of the water reservoir 2, and the circulation pump 8 and the sterilizer 100 are connected to the circulation path 20.

The inlet 3*a* is used as a waterway to drain the washing water in the water reservoir 2, and the three-way valve 9 is installed at the lower portion of the inlet 3*a* to switch the path such that the washing water introduced through the inlet 3*a* can be sent to the drain pipe 12 or the circulation pipe 7.

An injection nozzle 21 is installed at the outlet 3*b* such that the drained washing water can be spread over the wide range. The outlet 3*b* and the injection nozzle 21 are installed at the upper portion of the water reservoir 2, so that the washing water passing through the sterilizer 100 can be uniformly spread in the drum 3 and the water reservoir 2 when the washing water is discharged into the water reservoir 2.

As the washing or rinsing process starts, washing water is filled in the water reservoir 2 up to a predetermined water level, and the sterilizer 100 is positioned higher than the water level of the washing water. Accordingly, the electrodes 130 and 140 in the sterilizer 100 are not immersed in the washing water in a state when the circulation pump 8 is not operating, so that the sterilizer 100 can be prevented from being contaminated due to water remaining after the washing or rinsing process. In addition, even if the locking state of the door is released due to the abnormal operation of the washing machine, or other problems occur, electric shock can be prevented.

The two electrodes 130 and 140 of the sterilizer 100 are connected to a power supply 30 such that power can be supplied to the electrodes 130 and 140. The power supply 30 converts electric current such that DC power can be supplied to the electrodes 130 and 140.

The polarity of the DC power supplied to the electrodes 130 and 140 can be changed by a controller 40 that controls the power supply 30.

The sterilizer 100 operates in two modes. In the first mode, the first electrode 130 serves as an anode because positive (+) polarity of the DC power is connected to the first electrode 130 by the controller 40 and the second electrode 140 serves as a cathode because negative (−) polarity of the DC power is connected to the second electrode 140. In the second mode, the polarity of the electrode is inversed as compared to the first mode, so the first electrode 130 serves as the cathode and the second electrode 140 serves as the anode.

In detail, in the first mode, the first electrode 130 comprising Ag serves as the anode to emit Ag ions into the washing water. That is, the first electrode 130 and the second electrode 140 become the anode and the cathode, respectively, so electric current flows in the two electrodes. In addition, Ag is electrolyzed in the first electrode 130, so Ag ions in $Ag^+$ state are generated and supplied to the circulated washing water.

In the second mode, the polarities of the first and second electrodes 130 and 140 are inversed as compared with the first mode, so the second electrode 140 comprising Ti becomes the anode, and the first electrode 130 (Ag electrode) becomes the cathode.

In such a case, the Ag ions are not emitted through the first electrode 130 and electrolysis of the electrode is not performed in the second electrode 140. Accordingly, ions (e.g. $Ti^+$) are not generated in the second electrode 140, and electric current flows between the first electrode 130 and the second electrode 140 due to an electrolyte contained in the washing water or ions generated by the detergent.

In such a second mode, ions for sterilization are not directly generated, but ions contained in the washing water are activated. That is, compound in the neutral state contained in the washing water can be ionized through the electrolysis operation.

In particular, when Ag ions are emitted into the washing water in the first mode, if the Ag ions are reduced in the sterilization process and become electrically neutral, the sterilization effect is discontinued. Thus, the Ag ions in the neutral state are restored into Ag ions through the electrolysis operation.

In the second mode, the bacteria contained in the washing water are sterilized by the electric current flowing between the first electrode 130 and the second electrode 140. That is, the cell membrane of the bacteria contained in the washing water is partially destroyed by the electric current or pores may be formed in the cell membrane while the washing water is passing between the first electrode 130 and the second electrode 140.

The cell membrane of the bacteria subject to the electric current is destroyed and disappears. Even if the bacteria do not disappear, the Ag ions can easily penetrate into the bacteria. If the Ag ions have been emitted into the washing water in the first mode, the bacteria disappear due to penetration of the Ag ions.

The effect on the bacteria due to the electric current flowing between the first electrode 130 and the second electrode 140 is increased in proportion to the density of the electric current flowing between the two electrodes 130 and 140, that is, the electric current per unit area.

The sterilization function in the first and second modes as described above can be variously applied throughout the entire washing process, and embodiments regarding the sterilization function will be described.

In one embodiment, the sterilizer 100 operates in the first mode in order to emit Ag ions, and the first mode is switched to the second mode after a predetermined time period passes.

This can be commonly applied to the washing and rinsing processes. In FIG. 3, in a state where the washing water is supplied to the water reservoir 2 through the water supply valves 5 and the detergent supply apparatus 6, as the three-way valve 9 connects the inlet 3*a* to the circulation path 20 to form the circulation path 20, and the circulation pump 8 operates, the washing water is circulated through the circulation path 20 and the sterilizer 100 connected to the circulation path 20.

As the sterilizer 100 operates in the first mode, the Ag ions are emitted into the washing water through the first electrode 130, and the washing water containing the Ag ions are injected into the water reservoir 2 and the drum 3 through the injection nozzle 21, thereby exhibiting the antibiotic and sterilization functions.

After a predetermined time period passes, the sterilizer 100 operates in the second mode. That is, the cell membrane of the bacteria is subject to the electric current flowing between the two electrodes 130 and 140, so the bacteria is destroyed or disappears due to the Ag ions. Further, Ag, which has been emitted in the first mode and reduced through the sterilization process of the bacteria or other methods, is activated into Ag ions in the second mode.

The consumed Ag ions are restored through the procedure as described above, so that the operation time of the first mode can be shortened, and thus the consumption amount of Ag can be reduced in the first electrode.

In another embodiment, the sterilizer 100 operates in sequence of the second mode and the first mode. The reason of primarily operating the sterilizer 100 in the second mode is that the Ag ions emitted during the washing process may be affected by the high-density detergent dissolved in the washing water and other ions, and the sterilization function of the Ag ions may be interrupted. Thus, the sterilizer 100 operates in the second mode during the washing process such that the sterilization function due to the electric current between the first electrode 130 and the second electrode 140 can be exhibited, and then the sterilizer 100 operates in the first mode during the rinsing process, in which the density of the detergent is reduced, such that the Ag ions can be supplied to the washing water.

In further another embodiment, the washing machine can operate in a washing mode, in which the water reservoir and the drum are washed, separately from the washing and rinsing processes.

The washing mode corresponds to a dedicated washing process of removing biofilms formed in the water reservoir and the drum due to the propagation of bacteria. That is, in a state where washing water is supplied to the water reservoir without the laundry, the circulation pump 8 operates to circulate the washing water and the sterilizer 100 operates in the second mode or the first mode.

In order to improve the washing effect by the circulated washing water, a salt supply unit (not shown) can be provided to supply salt to the supplied water. The salt supply unit can be additionally provided to the washing machine, or can also be provided to the detergent box 6*b* of the detergent supply apparatus 6 (see FIG. 1).

As the salt is dissolved in the washing water, HOCl is generated through an electrolysis process. Since reaction and generation conditions for generation of the HOCl are well known to the skilled in the art, details thereof will be omitted here.

In order to improve the washing effect by the circulated washing water, a salt supply unit 6*c* can be provided to supply salt to the supplied water. The salt supply unit 6*c* can be additionally provided to the washing machine, or can also be provided to the detergent box 6*b* of the detergent supply apparatus 6 (see FIG. 1).

According to the washing machine of the present invention as described above, the sterilization effect can be maximized by using a small quantity of Ag and can be continued throughout the entire washing process, so that not only harmful microorganisms contained in the laundry but also microorganisms remaining or growing in the washing machine can be sterilized using the circulator, and thus the laundry can be prevented from being secondarily contaminated.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of machine washing comprising:

containing washing water in a water reservoir where articles for washing are located;

sterilizing the washing water introduced from the water reservoir through an electrolysis process by a sterilizer; and circulating the washing water introduced from the water reservoir by a circulator while it is being sterilized and the sterilized washing water is discharged into the water reservoir, the sterilizer being positioned higher than the water level of the washing water so that the washing water is only circulated in the sterilizer during operation of the circulator, wherein the sterilizing comprises supplying electric current to a first electrode including Ag and a second electrode including a metal having an ionization tendency lower than the ionization tendency of Ag; and switching the polarity of the electric current applied to the first and second electrodes based on a desired mode of operation of the sterilizing, wherein the sterilizer is positioned higher than the water level of the washing water and the washing water is prevented from contacting the electrodes during non-operation of the circulator.

2. A washing machine comprising:

a water reservoir to contain washing water;

a sterilizer comprising a first electrode including Ag and a second electrode including a metal having an ionization tendency lower than the ionization tendency of Ag to sterilize the washing water through an electrolysis process;

a circulator to circulate the washing water introduced from the water reservoir, sterilized in the sterilizer, and discharged into the water reservoir;

a power supply that supplies electric current to the first and second electrodes, and a controller that switches polarity of the electric current applied to the first and second electrodes, wherein the sterilizer is positioned higher than the water level of the washing water whereby the washing water is only in the sterilizer during operation of the circulator and the washing water is prevented from contacting the electrodes during non-operation of the circulator due to the sterilizer being positioned above the water level of the washing water, and wherein the first and second electrodes are protected from contamination when the circulator is not operating.

3. The washing machine of claim 2, wherein the second electrode comprises Ti.

4. The washing machine of claim 2, wherein the second electrode comprises Pt or Ir coated on a surface thereof.

5. The washing machine of claim 2, wherein the controller operates in a first mode, in which the first electrode becomes an anode and the second electrode becomes a cathode, or a second mode in which the second electrode becomes an anode and the first electrode becomes a cathode.

6. The washing machine of claim 2, wherein the circulator comprises a circulation pipe, which forms a circulation path such that the washing water is circulated along the circulation path in the water reservoir, and a circulation pump that pumps the washing water in the circulation path.

7. The washing machine of claim 6, wherein the circulation pipe is provided along a circumference of the water reservoir, wherein a section of the circulation pipe has a shape corresponding to the shape of the water reservoir.

8. The washing machine of claim 6, wherein the water reservoir comprises an inlet to introduce the washing water to the circulation path, and an outlet to discharge the washing water having passed the circulation path to the water reservoir.

9. The washing machine of claim 8, wherein the outlet is provided at an upper portion of the water reservoir.

10. The washing machine of claim 8, wherein the outlet is provided with an injection nozzle that injects the sterilized washing water such that the sterilized washing water is uniformly spread in the water reservoir.

11. The washing machine of claim 2, further comprising a salt supply unit that supplies salt to the washing water.

12. The washing machine of claim 11, wherein the salt supply unit is provided in a detergent supply apparatus that supplies detergent to the water reservoir.

* * * * *

UNITED STATES PATENT AND TRADEMARK OFFICE

CERTIFICATE OF CORRECTION

PATENT NO. : 8,239,990 B2
APPLICATION NO. : 12/078480
DATED : August 14, 2012
INVENTOR(S) : Jung Soo Lim et al.

It is certified that error appears in the above-identified patent and that said Letters Patent is hereby corrected as shown below:

Title Page, Item [75], Line 5-6, Delete "Tal Eun Kim," and insert -- Tai Eun Kim, --, therefor.

Signed and Sealed this
Twenty-seventh Day of November, 2012

David J. Kappos

David J. Kappos
*Director of the United States Patent and Trademark Office*